US011166878B2

(12) United States Patent
Macy, Jr. et al.

(10) Patent No.: US 11,166,878 B2
(45) Date of Patent: Nov. 9, 2021

(54) METHOD AND APPARATUS FOR PREPARING LIQUID SUSPENSIONS AND SOLUTIONS FROM MEDICATIONS IN PILL OR TABLET FORM

(71) Applicant: HOSPI CORPORATION, Newark, CA (US)

(72) Inventors: Bradford Macy, Jr., Concord, CA (US); Keith Wong, San Francisco, CA (US); John Eaton, Palo Alto, CA (US); Igal Ladabaum, San Carlos, CA (US)

(73) Assignee: Hospi Corporation, Newark, CA (US)

( * ) Notice: Subject to any disclaimer, the term of this patent is extended or adjusted under 35 U.S.C. 154(b) by 577 days.

(21) Appl. No.: 15/112,199

(22) PCT Filed: Jan. 27, 2015

(86) PCT No.: PCT/US2015/013067
§ 371 (c)(1),
(2) Date: Jul. 18, 2016

(87) PCT Pub. No.: WO2015/113040
PCT Pub. Date: Jul. 30, 2015

(65) Prior Publication Data

US 2016/0354282 A1 Dec. 8, 2016

Related U.S. Application Data

(60) Provisional application No. 61/932,180, filed on Jan. 27, 2014.

(51) Int. Cl.

| | |
|---|---|
| ***A61J 7/00*** | (2006.01) |
| ***A61J 3/02*** | (2006.01) |
| ***A61J 3/00*** | (2006.01) |

(52) U.S. Cl.
CPC ..... *A61J 7/0007* (2013.01); *A61J 3/02* (2013.01)

(58) Field of Classification Search
CPC .. A61J 7/0007; A61J 3/02; A61J 3/002; A47J 42/10
(Continued)

(56) References Cited

U.S. PATENT DOCUMENTS

| | | | |
|---|---|---|---|
| 405,019 | A | 6/1889 | Drude |
| 2,100,860 | A | 11/1937 | Lobley |

(Continued)

FOREIGN PATENT DOCUMENTS

| | | | |
|---|---|---|---|
| CN | 102413806 | A | 11/2010 |
| CN | 103338740 | A | 10/2013 |

(Continued)

OTHER PUBLICATIONS

Handle _ Definition of Handle at Dictionary, retrieved date Dec. 16, 2019.*

(Continued)

*Primary Examiner* — Faye Francis
*Assistant Examiner* — Mohammed S. Alawadi
(74) *Attorney, Agent, or Firm* — Shay Glenn LLP

(57) ABSTRACT

An apparatus for liquefying solid pills includes a grinder configured to grind the solid pills to a powder, a receptacle configured to attach to the grinder and to capture the powder, and a cap configured to attach to the receptacle. The cap includes a port therethrough in fluid connection with the receptacle. The port is configured to mate with a tip of a syringe.

21 Claims, 19 Drawing Sheets

(58) Field of Classification Search
USPC ..... 241/60, 169.1
See application file for complete search history.

(56) References Cited

U.S. PATENT DOCUMENTS

| | | | | |
|---|---|---|---|---|
| 2,886,253 | A | 5/1959 | Skibicki et al. | |
| 3,587,982 | A * | 6/1971 | Campbell | B05C 17/00566 241/62 |
| 4,026,490 | A * | 5/1977 | Johansson | A47J 42/04 241/169.1 |
| 4,057,052 | A * | 11/1977 | Kaufman | A61B 5/15003 600/578 |
| 4,212,430 | A | 7/1980 | Dale et al. | |
| 4,568,331 | A * | 2/1986 | Fischer | A61J 7/0007 206/221 |
| 4,715,854 | A * | 12/1987 | Vaillancourt | A61M 5/31511 141/2 |
| 5,123,915 | A * | 6/1992 | Miller | A61J 7/0053 606/234 |
| 5,337,925 | A * | 8/1994 | Ferrara, Jr. | A47J 43/16 222/214 |
| 5,464,393 | A * | 11/1995 | Klearman | A61J 7/0007 604/82 |
| 5,472,421 | A * | 12/1995 | Klearman | A61J 7/0007 604/218 |
| 5,478,311 | A * | 12/1995 | Klearman | A61M 5/31511 604/82 |
| 5,553,793 | A * | 9/1996 | Klearman | A61M 5/31511 241/30 |
| 5,626,299 | A * | 5/1997 | Haynes | A47J 42/04 241/169.1 |
| 7,735,763 | B2 | 6/2010 | Bell et al. | |
| 7,758,804 | B2 * | 7/2010 | Vidarsson | B22F 3/02 419/65 |
| 7,793,874 | B2 * | 9/2010 | Pai | A47J 42/40 241/101.2 |
| 7,975,943 | B1 | 7/2011 | Culves | |
| 8,033,488 | B2 | 10/2011 | Grah | |
| 8,259,543 | B2 | 9/2012 | Koide et al. | |
| 8,864,736 | B2 * | 10/2014 | Knight | A61J 9/04 604/403 |
| 9,044,547 | B2 * | 6/2015 | Tremolada | A61M 5/3286 |
| 2002/0117567 | A1 * | 8/2002 | Lee | A47J 42/04 241/169.1 |
| 2006/0151644 | A1 * | 7/2006 | Smith | A61J 7/0007 241/30 |
| 2008/0008761 | A1 * | 1/2008 | Cardon | A61J 7/0007 424/489 |
| 2010/0258565 | A1 * | 10/2010 | Isaacson | B09B 3/0075 220/324 |
| 2012/0006922 | A1 * | 1/2012 | Wilson | A47J 42/08 241/169.1 |
| 2013/0123747 | A1 * | 5/2013 | Tremolada | A61M 19/00 604/506 |
| 2013/0299615 | A1 | 11/2013 | Priebe et al. | |
| 2014/0312152 | A1 * | 10/2014 | Pai | A47J 42/04 241/169.1 |
| 2017/0028131 | A1 * | 2/2017 | Perazzo | G16H 20/17 |

FOREIGN PATENT DOCUMENTS

| | | | |
|---|---|---|---|
| DE | 2852398 | A1 | 6/1979 |
| DE | 102010017331 | A1 | 12/2011 |
| WO | WO2014/125006 | A1 | 8/2014 |

OTHER PUBLICATIONS

Guenter et al.; Enteral feeding misconnections: a consortium position statement; The Joint Commission Journal on Quality and Patient Safety; 34(5); pp. 285-292; May 1, 2008.

* cited by examiner

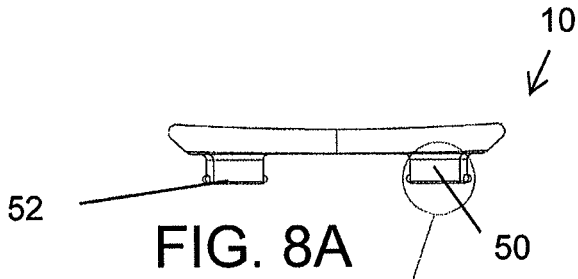
FIG. 8A
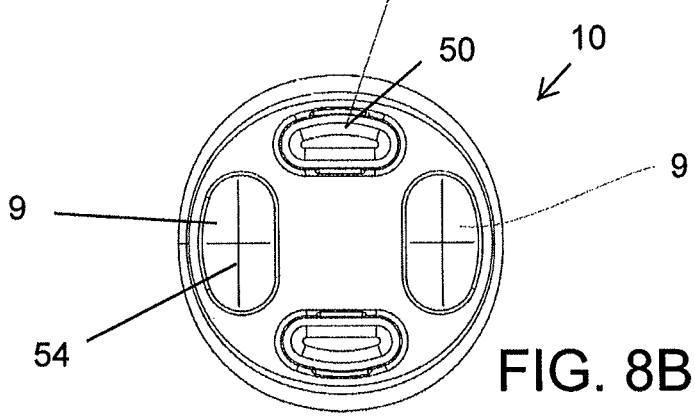
FIG. 8B
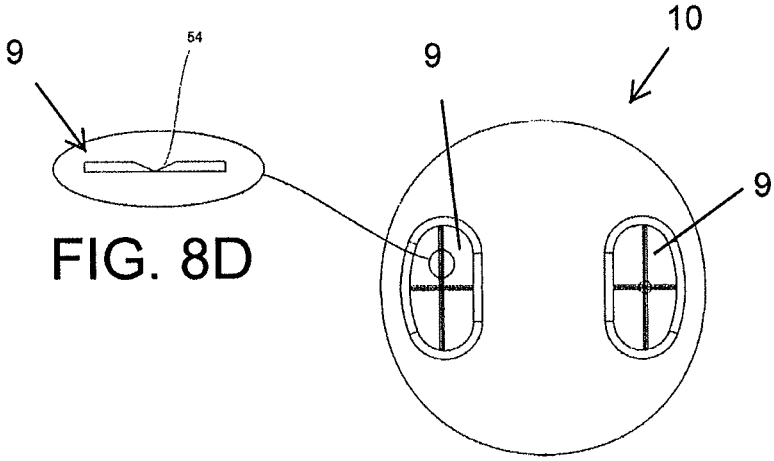
FIG. 8D
FIG. 8C

METHOD AND APPARATUS FOR PREPARING LIQUID SUSPENSIONS AND SOLUTIONS FROM MEDICATIONS IN PILL OR TABLET FORM

CROSS REFERENCE TO RELATED APPLICATIONS

This application claims priority to U.S. Application No. 61/932,180, filed Jan. 27, 2014, and titled "METHOD AND APPARATUS FOR PREPARING LIQUID SUSPENSIONS AND SOLUTIONS FROM MEDICATIONS IN PILL OR TABLET FORM," the entirety of which is incorporated by reference herein.

INCORPORATION BY REFERENCE

All publications and patent applications mentioned in this specification are herein incorporated by reference to the same extent as if each individual publication or patent application was specifically and individually indicated to be incorporated by reference.

FIELD

This invention relates to the preparation of medications, vitamins, supplements or other ingestible pills or tablets for delivery into a body cavity and more particularly, but not limited to, grinding and crushing the solid pills into a powder, suspending or dissolving the powder in liquid, and drawing the liquid mixture into a syringe for oral or enteral administration.

BACKGROUND

Many instances occur in which it is desirable to change the consistency of a medication in solid pill or tablet form to a liquid suspension or solution. Pills and tablets are the most common, and usually the least expensive, form of medication. However, children and pets are often unable to swallow pills, but can readily ingest liquids. Moreover, when geriatric patients have difficulty swallowing, pills are often crushed and given in food or liquid for easier ingestion. If swallowing is completely compromised, medications may be given into the gastrointestinal tract through a feeding tube (i.e. gastrostomy tube, jejunostomy tube, orogastric tube, or nasogastric tube). Another delivery option is through the rectal route via a rectal medication administration device. In order to provide a liquid solution or suspension for swallowing or to get the medications through the feeding tube or medication administration devices mentioned above, solid medications need to be crushed or ground into a powder and then mixed with a liquid. The powder should be fine and relatively uniform for patient comfort during swallowing and to avoid clogging of tubes or syringes.

Crushers and grinders have been used for millennia, for example the mortar and pestle type tools. With a mortar and pestle type pill crusher, particles can be ground to a very fine powder if used diligently and correctly, but the user must have good vision, good fine motor coordination, and good finger strength and flexibility to use the pestle to assure all particles have been crushed into a suitable size. The pestle must be run around in circles along the base of the mortar, applying both a crushing and a grinding action. The user must visually inspect to assure proper crushing and grinding. Many patients or their caregivers have varying dexterity or training, and may be elderly, have arthritis, poor vision, or other disability that makes the use of the mortar and pestle difficult. Users with even moderate visual impairment would not be able to use a mortar and pestle to guarantee a finely ground and/or uniform powder substance. Another potential problem with mortar and pestle type devices is that chunks of the medication being crushed can be ejected out of the crushing device and/or powder from the medication pulverizing process can become airborne during crushing. These problems can lead to medication loss and sub-optimal dosing, as well as potential contamination of the surrounding environment.

Other exemplary crushers are hammer pill crushers and screw-twist pill crushers. Hammer pill crushers work by crushing the pills between two surfaces forced toward each other. Screw-twist type pill crushers work similarly, i.e. by a tightening action of an upper portion against a lower portion when the two parts of the device are twisted, screwing the parts close together. These devices apply only a crushing force and very little, if any, friction force to break particles. In fact, with continued crushing, the force can be large enough within these devices that particulates from the initial crush can aggregate under the pressure and re-compress into larger chunks. Such large chunks can cause clogging of tubes or syringes and/or can result in patient discomfort. Moreover, the actions required to use hammer and screw-type crushers can be difficult for users of low dexterity or visual acuity.

In addition to the challenge of crushing and grinding solid medications to sufficiently small particles, the preparation of a liquid suspension or solution from the pulverized medication can be even more problematic. The user must be able to combine the correct amount of liquid with the medication, mix it, and deliver it, all without spilling medication. This process usually involves measuring the correct amount of liquid, adding the liquid to the medication (or the medication to the liquid), and then agitating in some manner to create a thoroughly mixed suspension or solution. These tasks can be ergonomically difficult to perform. More significantly, medication can be inadvertently lost at various steps so that an incomplete dose is delivered to the patient. Medication can be lost during transfer of pulverized medication to the liquid due to spillage or residual medication in the container. Medication can also be lost if spillage occurs due to the mixing step occurring in an open container or if residual suspension remains in the mixing container due to difficulty in loading the delivery vehicle (syringe, spoon, or other device).

Yet a further challenge occurs during the administration of liquid into gastro-enteral tubes. That is, the use of proper syringes for gastro-enteral administration is critical. Injuries, and even death, have occurred when laypersons, and even trained professionals, accidentally use a luer type syringe for gastro-intestinal medication administration. The accidents usually occur when luer type syringes (meant for injections and IV's) are used to draw up non-sterile medication meant for the GI tract and are accidentally used to inject the non-sterile medication into an intravenous device.

A method and/or apparatus is needed to address the problems described above so as to make the process of grinding, liquefying and administering solid medications, vitamins, or supplements into to the gastrointestinal tract easy, safe and reliable for layperson users in the home setting, and, indeed all users in all settings. Such a device would improve the safety, medical care, and quality of life for patients receiving such medication.

SUMMARY OF THE DISCLOSURE

It is an object of the present invention to provide a device to consistently and easily grind solid forms of medications into particles fine enough to pass through enteral tip syringes and the lumen of a feeding tube or enteral medication administration device where the resulting particle size is not dependent on user dexterity, strength, or visual acuity.

It is a further object of the present invention to provide a device to grind medications without loss of medication or contamination of the environment from the grinding process.

It is a further object of the present invention to provide a device to mix ground medications with accurately measured liquid without the need to transfer the pulverized medication to a receptacle, decreasing the chance of spillage, contamination, or loss of the medication or fluid.

It is a further object of the present invention to provide a device to easily draw suspended medication into an oral or enteral type syringe directly from a receptacle through a spill proof port that: (1) prevents leakage of medication from the receptacle when a syringe is not attached; (2) prevents connection with a luer type syringe; and (3) prevents significant residual medication to remain within the receptacle after the syringe is loaded.

In general, in one embodiment, an apparatus for liquefying solid pills includes a grinder configured to grind the solid pills to a powder, a receptacle configured to attach to the grinder and to capture the powder, and a cap configured to attach to the receptacle. The cap includes a port therethrough in fluid connection with the receptacle. The port is configured to mate with a tip of a syringe.

This and other embodiments can include one or more of the following features. The grinder can be configured to grind the solid pills to a powder having a particle size of less than or equal to 1 mm. The apparatus can further include a lid configured to cover the grinder. The lid can include a slotted opening configured to allow the solid pills to pass therethrough. A portion of the lid surrounding the slotted opening can be made of an elastomeric material. The lid can be configured to be attached and detached from the grinder during normal use of the apparatus. The grinder can include an annular grinder portion having teeth on an inner surface thereof and a central grinder portion having sharp edges on an outer surface thereof. The teeth of the annular grinder portion and the sharp edges of the inner grinder portion together can be configured to grind the solid pills to a powder. The annular grinder portion and the central grinder portion can be rotatable with respect to one another. The relative rotation can be configured to grind the solid pills to a powder. The sharp edges of the central grinder can be configured as spiraling sharp edges. The central grinder portion can further include teeth, and the annular grinder portion can further include burrs. The teeth of the central grinder and the burrs of the annular grinder together can be configured to further grind the solid pills to a powder. There can be an opening between the annular grinder portion and the central grinder portion that is less than or equal to 0.05 inches wide, and the opening can be in communication with the receptacle for passage of the powder thereto. There can be an opening between the annular grinder portion and the central grinder portion. The apparatus can further include an adjustment mechanism configured to adjust the width of the opening. A tooth radius of each of the teeth in the annular grinder can be less than or equal to 0.03 inches. The teeth of the annular grinder portion can be at least two different sizes. A pattern of teeth of the annular grinder can vary along the inner surface of the annular grinder. The central grinder portion can increase in diameter from a first end to the receptacle, and the annular grinder portion can decrease in diameter from the first end to the receptacle. The receptacle can include a first attachment mechanism and a second attachment mechanism. The first attachment mechanism can be configured to attach to the grinder and the second attachment mechanism can be configured to attach to the cap. The receptacle can include an attachment mechanism that is configured to attach to both the grinder and the cap. The port can be configured to mate with a tip of an enteral syringe. The port can be configured to mate with only a tip of an enteral syringe. The port can be configured to mate with a tip of an oral syringe. The port can include a valve therein. The valve can be a two-way valve. The valve can be a slit valve. The slit valve can include two slits. The cap can have a tapered portion extending to the port. The tapered portion can have an angle between an inner surface of the cap and a central axis of the device that is less than 60 degrees. The apparatus can further include an adaptor. The adaptor can have a first end configured to attach to the port and a second end configured to mate with the tip of the syringe. The grinder can be configured to grind pills having an original size of between 0.004 $in^3$ and 0.066 $in^3$. The apparatus can further include a splash guard between the receptacle and the grinder that can be configured to prevent liquid from entering the grinder. The apparatus can further include a handle attached to the grinder that can be configured to rotate to allow the grinder to grind the solid pills to a powder. The handle can include openings configured to allow the solid pills to pass therethrough into the grinder.

In general, in one embodiment, a method of liquefying solid pills includes: (1) grinding at least one pill in a grinder to form a powder; (2) capturing the powder in a receptacle that is attached to the grinder; (3) adding a liquid to the receptacle; (4) mixing the liquid with the powder to form a liquid powder mixture in the receptacle; and (5) placing a tip of a syringe through a port of a cap on the receptacle to remove the liquid powder mixture from the receptacle.

This and other embodiments can include one or more of the following features. The method can further include attaching the grinder to the receptacle. The method can further include attaching the cap to the receptacle. More than 85% of the powder captured in the receptacle can be removed by the syringe. More than 95% of the at least one pill can be captured by the grinder and moved to the receptacle. Grinding can include rotating an annular grinder portion of the grinder relative to a central grinder portion of the grinder. The rotating step can be performed with a rotatable handle connected to the grinder. Placing a tip of a syringe through the port can include placing the tip of the syringe through a valved port. The liquid can be flavored. The liquid can be water. The method can further include placing the at least one pill through a slotted opening in a lid covering the grinder. The method can further include removing a lid from the grinder to clean the grinder or to confirm that all of the pills in the grinder have been ground into powder. The syringe can be an enteral syringe. The port can be configured to mate only with an enteral syringe. The syringe can be an oral syringe. The mixing step can be performed by shaking the receptacle.

In general, in one embodiment, an apparatus for liquefying solid pills includes a grinder configured to grind the solid pills to a powder and a receptacle configured to attach to the grinder and to capture the powder. The receptacle includes a port therein configured to mate with a tip of a syringe.

In general, in one embodiment, a grinder configured to grind solid pills to a powder includes an annular grinder portion having teeth on an inner surface thereof, a central grinder portion having sharp edges on an outer surface thereof, a handle, and a lid. The teeth of the annular grinder portion and the sharp edges of the inner grinder portion are together configured to grind the solid pills to a powder. The handle is attached to the grinder and configured to rotate to allow the grinder to grind the solid pills to a powder. The lid is attached to the handle and configured to cover the grinder. The lid includes an opening therein configured to allow solid pills to pass therethrough.

BRIEF DESCRIPTION OF THE DRAWINGS

The novel features of the invention are set forth with particularity in the claims that follow. A better understanding of the features and advantages of the present invention will be obtained by reference to the following detailed description that sets forth illustrative embodiments, in which the principles of the invention are utilized, and the accompanying drawings, of which:

FIG. 2A is a front view. FIG. 2B is a cross-section.

FIG. 6A is a perspective view. FIG. 6B is a line drawing of the same. FIG. 6C is a cross section of the same.

FIG. 7A is a perspective view. FIG. 7B is a line drawing and detail of an upper view of the same. FIG. 7C is a cross section of the same.

FIGS. 8A-8D show close-ups of a lid portion of a medication grinding apparatus. FIG. 8A is a lateral view of the lid. FIG. 8B is a view from the bottom of the lid. FIG. 8C is a top view of the lid. FIG. 8D is the beveled edges of a lid.

FIG. 9A is a perspective view. FIG. 9B is a top view of the same. FIG. 9C is a view of the bottom of the same.

FIG. 11A is a perspective view. FIG. 11B is a side view. FIG. 11C is a cross-sectional view.

FIG. 12A is a perspective view of the grinder. FIG. 12B is a close-up of the burrs.

FIG. 13A is a perspective view. FIG. 13B is a top-down view. FIG. 13C is a cross sectional view.

FIG. 14A is a perspective view. FIG. 14B is an exploded side view. FIG. 14C is a cross-sectional view. FIG. 14D is a top-down view.

FIG. 15A is a perspective view. FIG. 15B is a cross-sectional view.

FIG. 16A is a side view. FIG. 16B is a cross-sectional view. FIG. 16C is a cross-sectional view of the enteral syringe attached to the medication grinding apparatus.

FIG. 17A is a cross-section with the adjustable spacing set to finer grind. FIG. 17B is a side view. FIG. 17C is a top view.

FIG. 19A shows an adaptor that receives a male slip fit enteral syringe and connects to an ENFit enteral connector. FIG. 19B shows an adaptor that has a male slip fit section that mates with the valved cap port, and is configured to connect with female ENFit connectors.

DETAILED DESCRIPTION

Described herein is a medication grinding apparatus including a grinding unit for grinding pills or tablets, a receptacle unit for holding the ground tablets, and a valved cap unit for connection to a syringe or other device for adding/removing liquid from the receptacle unit.

Advantageously, the medication grinding apparatus and the associated method of use described herein enable the preparation of suspensions or solutions of medications in tablet or pill form by: (1) grinding the medication to a consistent particulate size small enough (e.g., having a maximum dimension of less than or equal to 2 mm, such as less than or equal to 1 mm) to promote dissolution/suspension in liquid and easily pass through the syringe injecting the medication and the lumen of the tube; (2) preventing significant amount of medication loss through ejection of chunks or powder becoming airborne; (3) allowing for a specific and accurate amount of liquid to be added to the ground medication and mixed to suspend or dissolve the medication in the fluid; and (4) ensuring that the liquid mixture can be drawn only by an enteral syringe.

Figure 1:
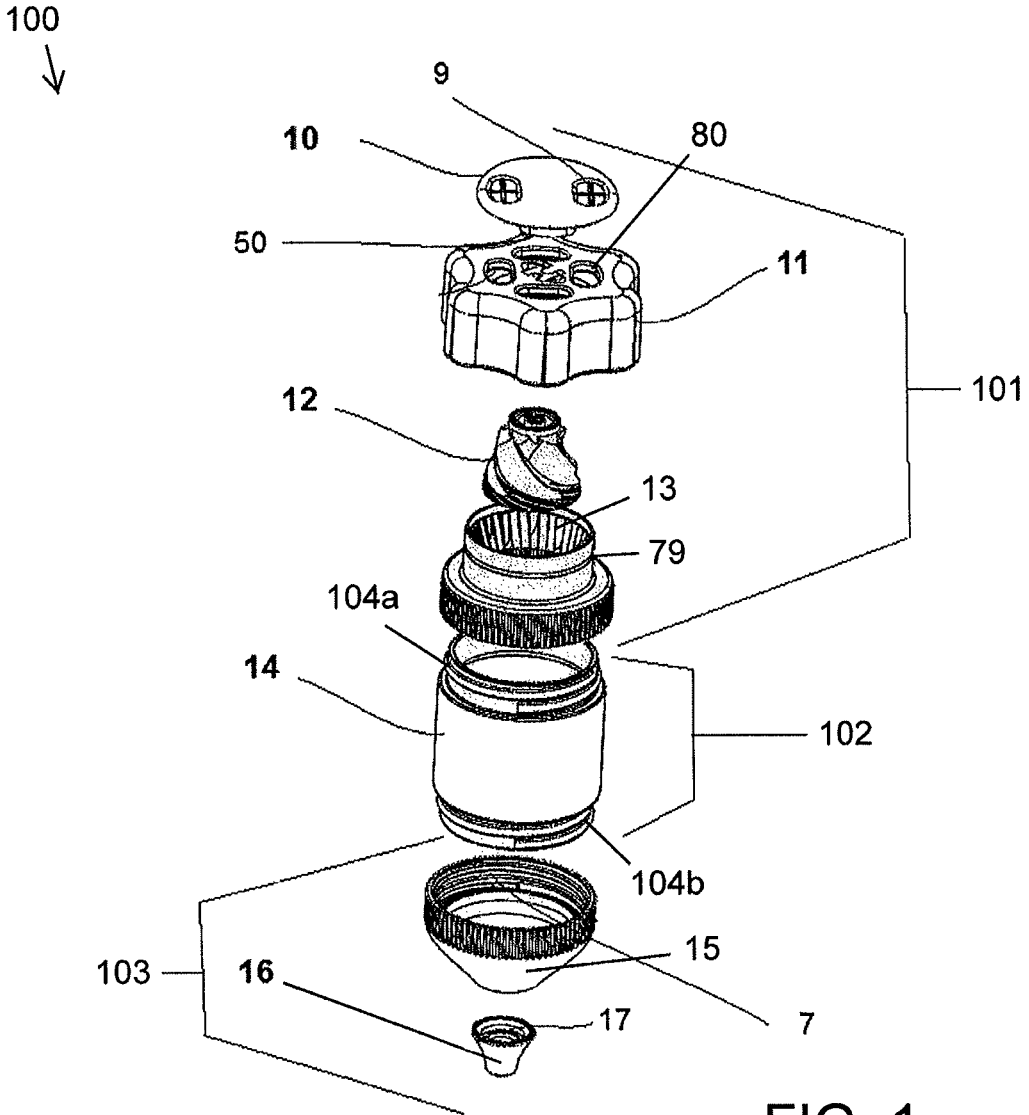
FIG. 1 is an exploded view of one embodiment of a medication grinding apparatus for simplified crushing, liquefying and preparing of medications.
Figure 2A:
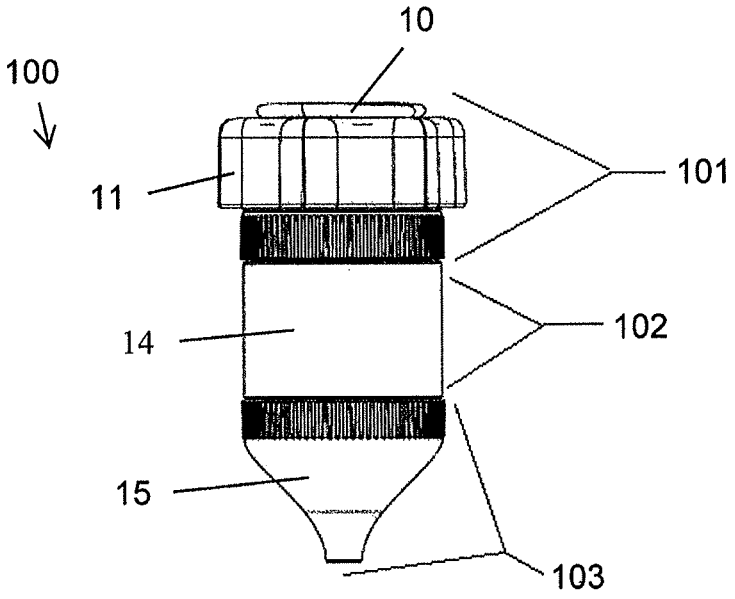
FIGS. 2A-2B show the assembled apparatus of FIG. 1.
Figure 2B:
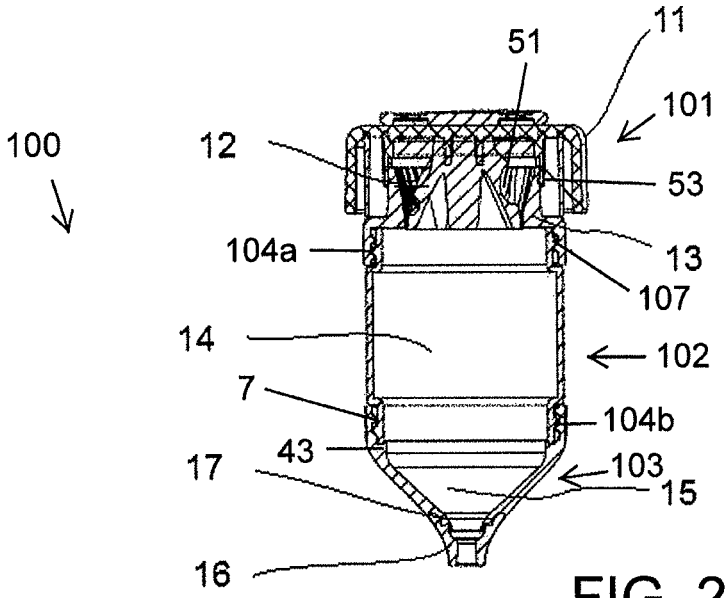

Referring to FIGS. 1-2B, a medication grinding apparatus 100 includes a grinding unit 101, a receptacle unit 102, and a valved cap unit 103. As shown in FIGS. 1-2B, the grinding unit 101 attaches to one side (e.g., the top) of the receptacle unit 102 while the valved cap unit 103 attaches to the other side (e.g., the bottom) of the receptacle unit 102.

The grinding unit 101 includes a lid 10, a grinder handle 11, a central grinder 12, and an annular grinder 13. The lid 10 can include slotted openings 9, described further below, that allow pills or tablets to be placed therethrough. Further, the lid 10 can fit into the grinder handle 11 such that two protrusions 50 on the lower surface of the lid 10 fit into openings 80 on the grinder handle 11, thereby holding the lid 10 in place. In one embodiment, the lid 10 can be made of a soft elastomeric material that is pliable and both allows pills to slide through the openings 9 and allows the protrusions 50 to be squeezed though the holes and stay in place by re-expansion or interference fit.

The central grinder 12 and annular grinder 13 can be configured to rotate relative to one another when activated by the grinder handle 11. Thus, when medication is placed in the chamber 51 (see FIG. 2B and FIG. 5) therebetween, the medication can be ground by the relative rotation of the central grinder 12 and the annular grinder 13, as described further below, down to a maximum dimension of less than 2 mm, such as less than 1 mm. The central grinder 12 can be attached to the grinder handle 11, such as with ultrasonic welding, a screw, or adhesive. This attachment allows for the central grinder 12 to turn when the user twists the grinder handle 11, thereby providing relative rotation between the central grinder 12 and the annular grinder 13. The central grinder 12 can sit inside the annular grinder 13, suspended by the grinder handle 11. The central grinder 12 and grinder handle 11 are held in place relative to the annular grinder 13 by an indentation 79 molded into the outer surface and running completely around the periphery of the annular grinder 13, which mates with a lip 53 (see FIG. 2B and FIG. 5) on the inside corresponding surface of the handle 11. This indentation and lip arrangement allow for the handle 11 to rotate the central grinder 12 about the annular grinder 13, while at the same time keeping the two parts aligned on the same axis. Moreover, this arrangement keeps the inner chamber 51 between the annular and central grinders 13, 12 approximately equal around the circumference to maintain consistency in ground particle size when medication is placed therebetween.

The receptacle unit 102 can include a cylindrical body 14, such as a plastic molded body having a smooth inner surface (e.g., to help prevent trapping of particles and/or solution residue). The cylindrical body 14 can be 20-100 ml in size, e.g., 30-90 ml, or 40-80 ml, such as approximately 60 ml. The receptacle unit 102 can include attachment mechanisms to attach to both the grinder unit 101 and the valved cap unit 103. For example, the cylindrical body 14 can include molded screw grooves 104*a,b* on both ends. These screw grooves 104*a,b* can accept screw grooves 107 (see FIG. 2B) on the inner surface of the annular grinder 13 and screw grooves 7 (see FIG. 1) on the inner surface of the valved cap body 15. When combined with the grinder unit 101 and the valved cap unit 103, an enclosed receptacle can be formed within the receptacle unit 102 to hold medication therein.

The valved cap unit 103 can include a cap body 15, a rigid port 16, and a valve 17. The valve 17 can be a two-way valve, such as a slit valve, and can be seated within the inner wall of the port 16. In one embodiment, the opening of the port 16 that receives the syringe can be of the size and taper of most standard enteral syringes, as described below. A small protruding lip 43 (see FIG. 2B), molded around the inner circumference of the cap body 15, can form a water-tight seal around the top inner edge of the receptacle without the need for a gasket.

During use of the medication grinding apparatus 100, pills or tablets of medication can be placed through the slots 9 in the lid 10 and ground into the receptacle unit 102 by turning the handle 11 with one hand and holding the cylindrical body 14 with the other. When grinding is complete, liquid, such as water or other solvent, can be added to the ground medication within the inner receptacle by placing an enteral syringe through the valved cap unit 103. The syringe can be removed or remain attached to the valved unit 103, and the ground medication and liquid can be mixed within the enclosed receptacle by agitation, e.g., swirling and/or shaking, without the chance of spillage. After mixing, the medication suspension/solution can be drawn from the receptacle into a syringe (either the same syringe or a new syringe) for delivery.

Figure 3:
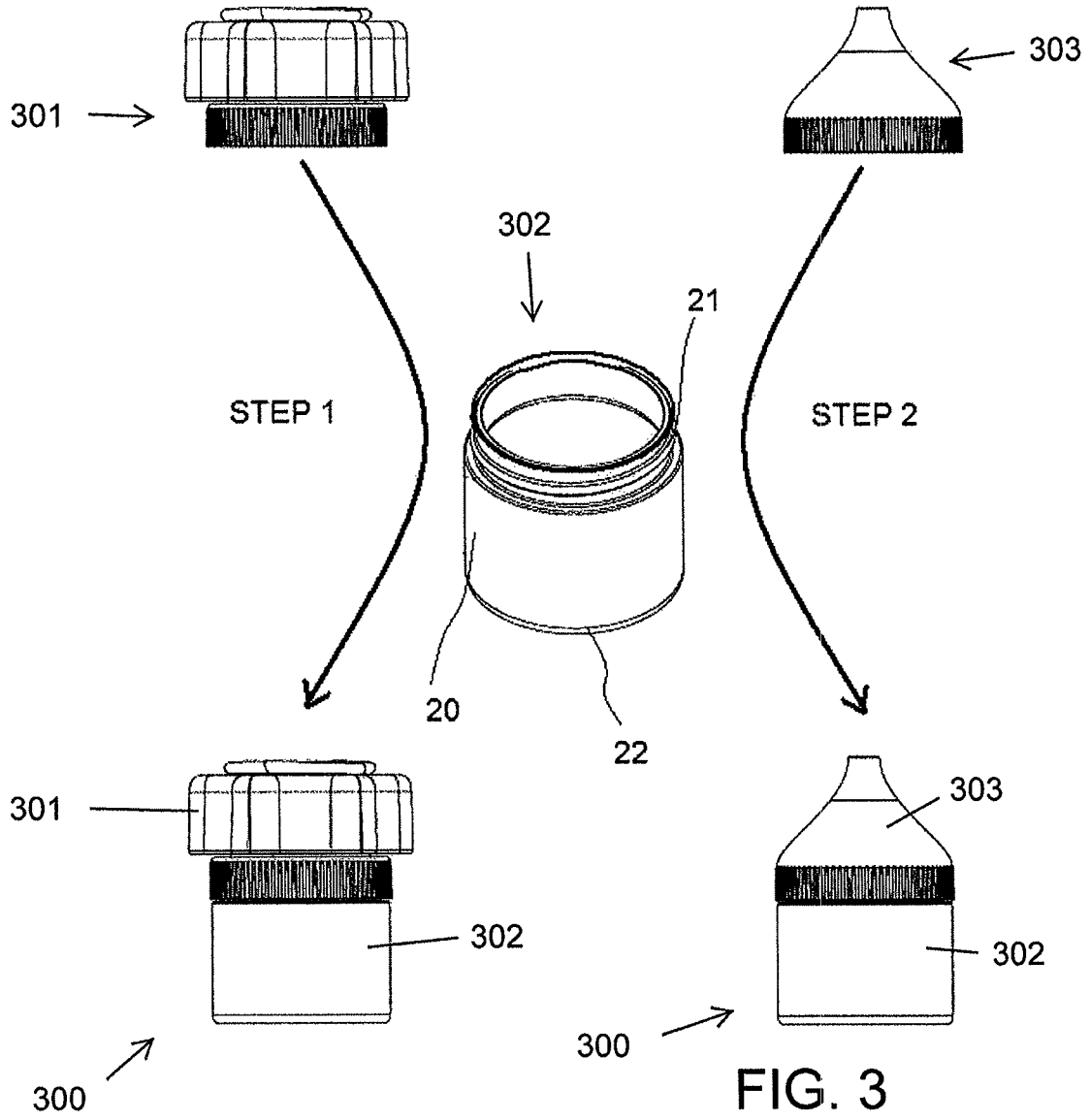
FIG. 3 shows a method of using one embodiment of a medication grinding apparatus wherein the grinder unit is placed on the receptacle unit first, medications are ground, then the grinder unit is removed and the valved cap unit is placed on the receptacle for the addition of fluid, mixing of the fluid/medication, and drawing of the resulting formulation into syringe.
Figure 4:
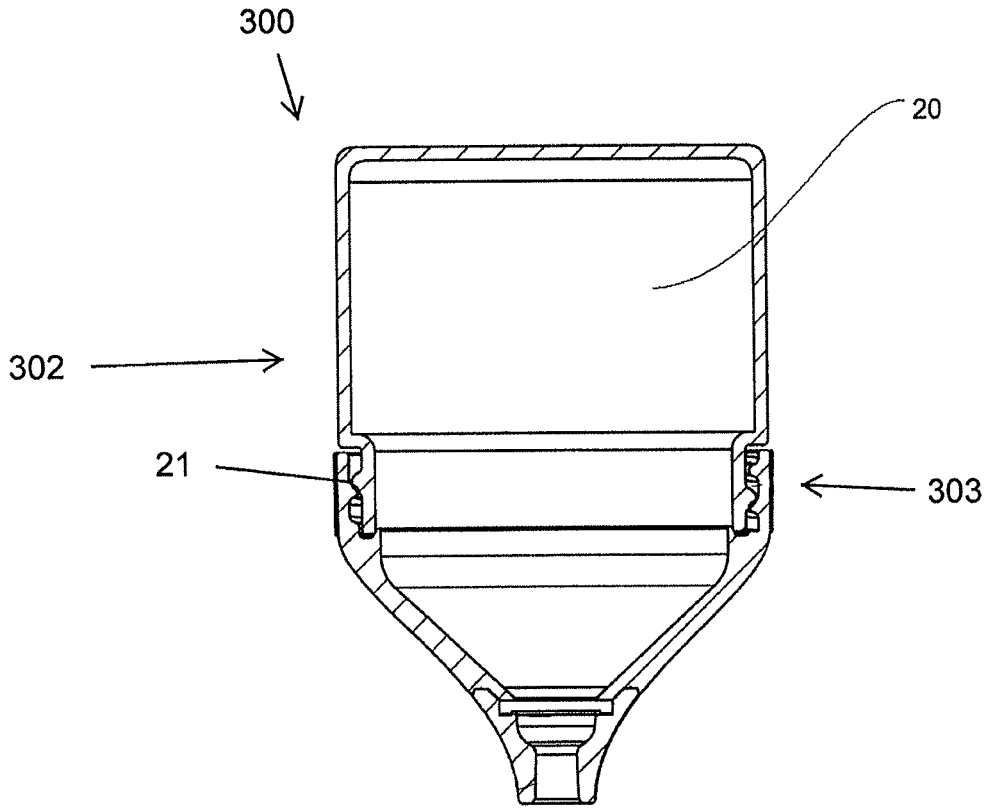
FIG. 4 is a cross-section of the apparatus of FIG. 3 with the valved cap unit attached to the receptacle unit.
Figure 5:
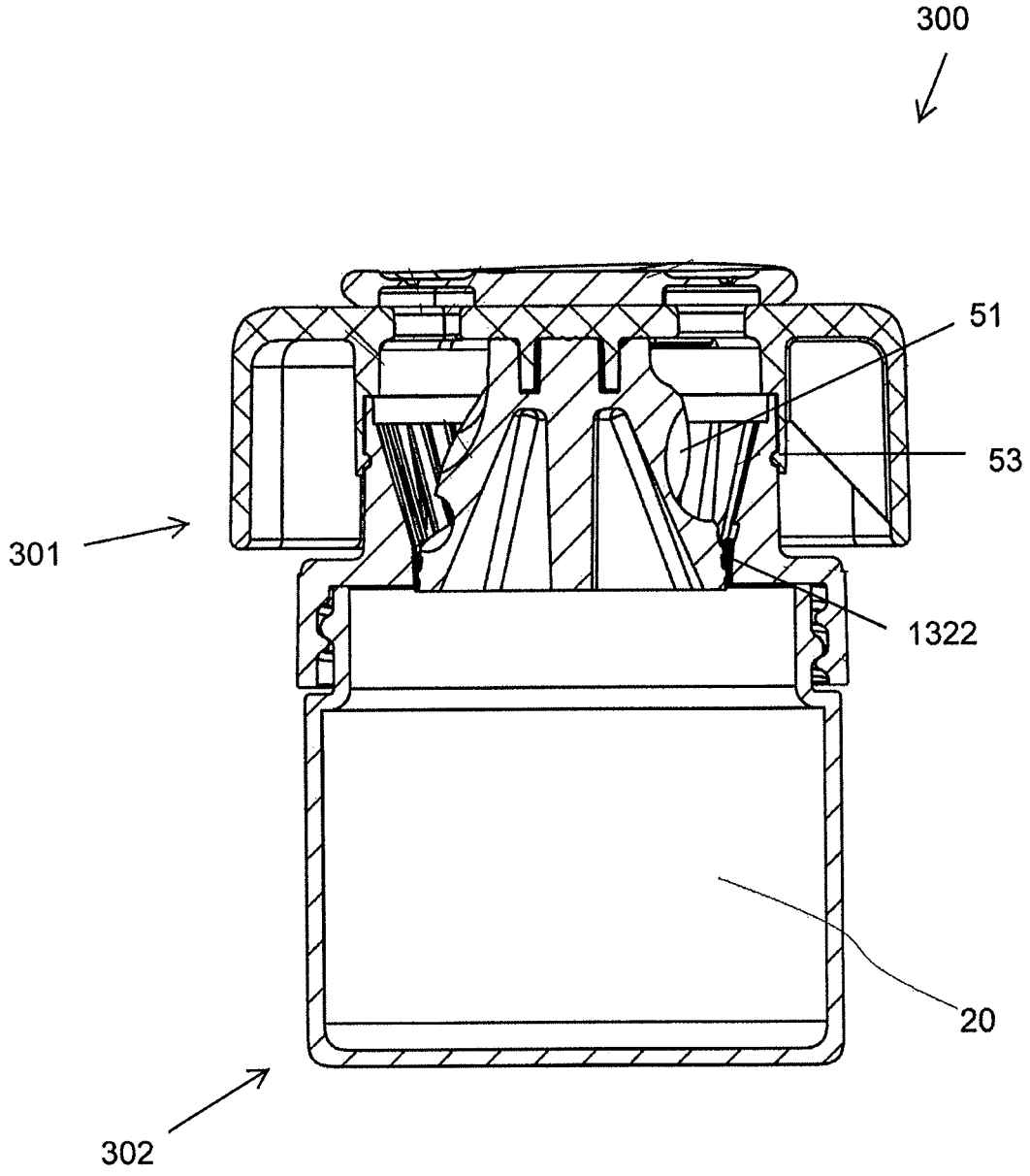
FIG. 5 is a cross-section of the apparatus of FIG. 3 with the grinder unit attached to the receptacle unit.

Referring to FIGS. 3-5, in an alternate embodiment, a medication grinding apparatus 300 is configured such that the valved cap unit 303 is not attached to the receptacle unit 302 at the same time as the grinder unit 301. Instead, the grinder unit 301 and valved cap unit 303 are attached to the receptacle unit 302 at the same location and are thus placed on the receptacle unit 302 at different points in the process.

The receptacle unit 302 has a cylindrical body 20 with only one set of screw grooves 21 and a solid floor 22. The receptacle unit 302 and the grinder unit 301 can include many or all of the same features as the receptacle unit 102 and the grinder unit 101.

Referring to FIG. 3, during use of the medicine grinding apparatus 300, the grinder unit 301 can first be placed on the receptacle unit 302 (step 1), and the pills or tables can be ground. The grinder unit 301 can then be removed from the receptacle unit 302, and the valved cap unit 303 can be placed on the receptacle unit 302 (step 2) to allow for fluid to be added and medication-fluid mixture to be withdrawn from the receptacle through the valved cap unit 303. Advantageously, the apparatus 300 can allow for vigorous shaking once the valved cap unit 303 is placed on the receptacle unit 302 without spilling any solution into or through the grinder unit 301.

Figure 6A:
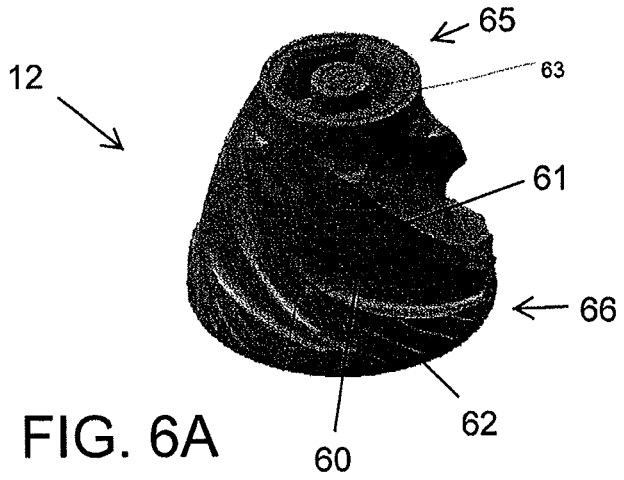
FIGS. 6A-6C show close-ups of a central grinder of a medication grinding apparatus.
Figure 6C:
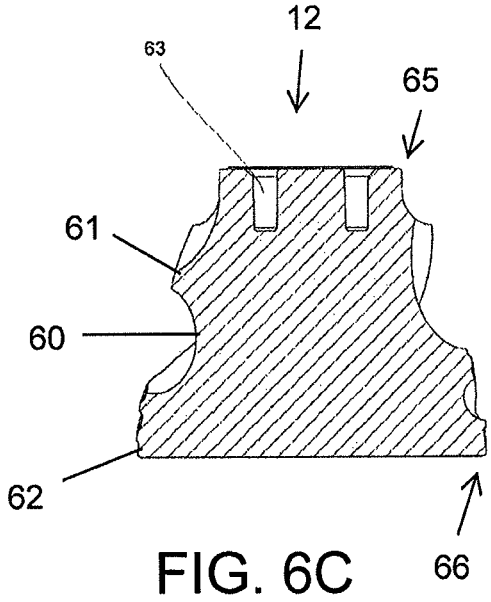
Figure 6B:
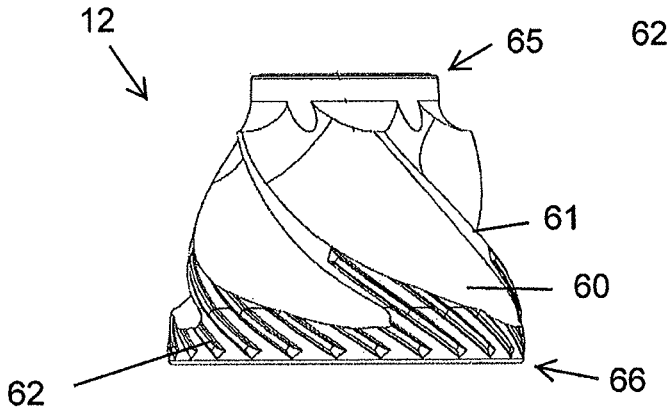

A close-up of the central grinder 12 of the grinding unit 101/301 is shown in FIGS. 6A-6C. The central grinder 12 can be shaped like a tapered drill bit with a top surface 65 having a smaller diameter than a bottom surface 66. A hexagonal indentation 63 on the upper surface 65 of the central grinder 12 can be configured to mate with a hexagonal peg in the gripping handle 11 to increase torque strength, and the two units can be affixed by an ultrasonic weld or other adhering means. Further, the central grinder 12 can include spiraling indentations 60 along the outer surface of the central grinder 12 that decrease in size (i.e. become narrower and smaller) as they transition from the upper surface 65 to the lower surface 66. Sharp edges 61 formed on the outer profile of these indentations 60 can be configured to break a pill or tablet into smaller pieces. The lowest portion of the central grinder 12 can include smaller spiraling burrs 62 along the outer surface. In one exemplary embodiment, the central grinder upper indentations 60 are approximately 0.38 in wide by 0.18 in deep at the top tapering to 0.09 in wide by 0.05 in deep. Smaller spiral burrs 62 are 0.040 in wide by 0.015 in. deep.

Figure 7A:
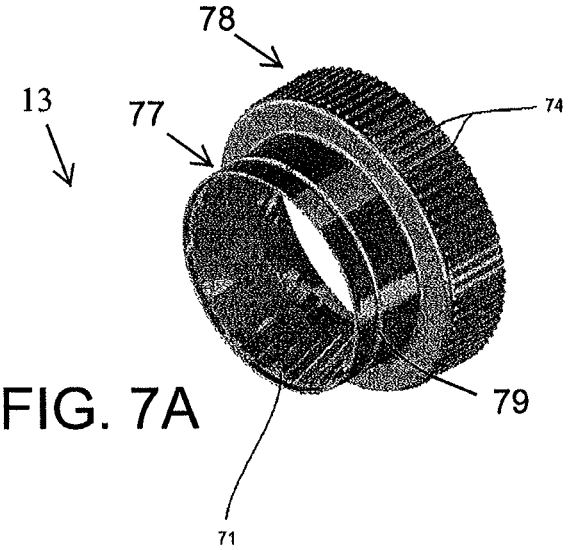
FIGS. 7A-7C show close-ups of an annular grinder of a medication grinding apparatus.
Figure 7C:
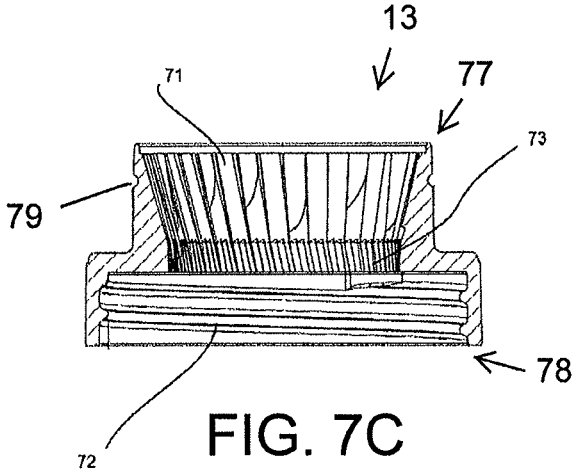
Figure 7B:
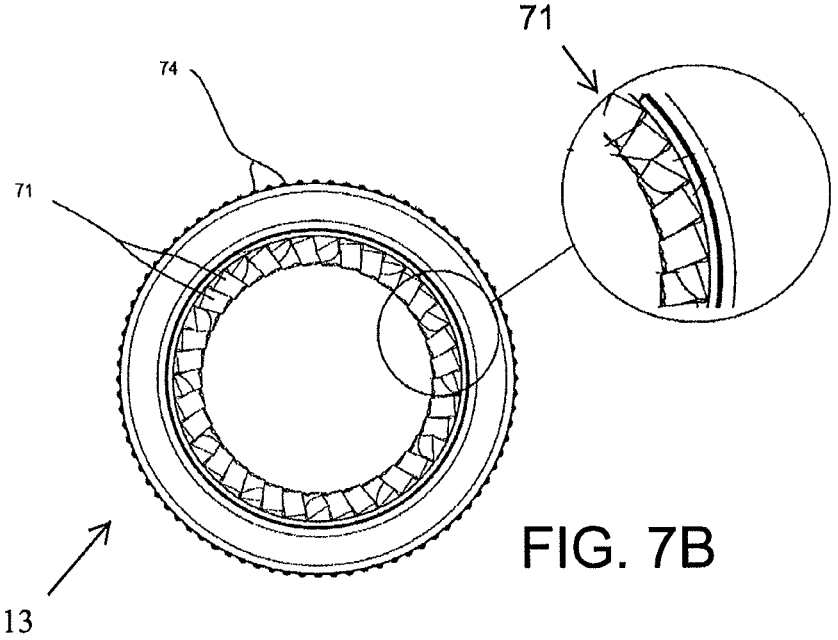

A close-up of the annular grinder 13 of the grinding unit 101 is shown in FIGS. 7A-7C. The annular grinder 13 can include large burrs 71 extending along the inside surface from the top 77 of the annular grinder 13. The large burrs 71 can have a circumferential width ranging, for example, between 0.05 inches and 0.2 inches. Smaller burrs 73 can extend from the bottom of the large burrs 71 towards to the bottom 78 of the annular grinder 13 to progressively grind the pills into smaller powder. The smaller burrs 71 can have a circumferential width, for example, of less than 0.05 inches. The burrs 71, 73 can angle slightly inward from the top 77 of the annular grinder 13 to the bottom 78 of the annular grinder. Moreover, the burrs 71, 73 can include sharp edges that allow for a cutting action to easily break the pills or tablets. Ridges 74 on the outside surface of the grinder 13 can provide a gripping surface to loosen or tighten the grinder unit 101 to mate the screw threads 72 with the screw threads on the receptacle unit 102.

Figure 12B:
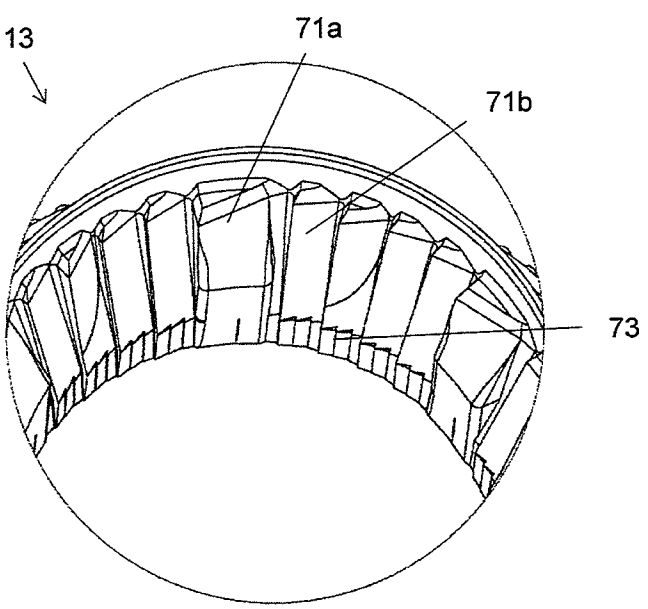
FIGS. 12A-12B show an embodiment of an annular grinder having varying sized burrs around the circumference.
Figure 12A:
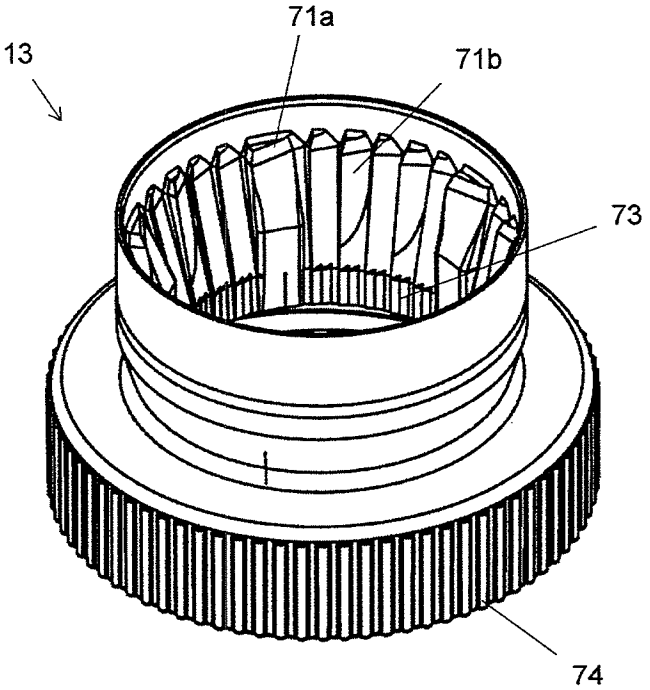

Referring to FIGS. 12A and 12B, in some embodiments, the annular grinder 13 is designed such that the large burrs 71 may vary in size within the same embodiment. For example, there can be a first type of large burr 71*a* and a second type of large burr 71*b*, where the first type 71*a* is larger than the second type 71*b*. In one embodiment (shown in FIGS. 12A and 12B), there are six burrs 71*a* spaced around the perimeter of the annular grinder 13. Sets of burrs 71*b* extend between neighboring burrs 71*a*. The edges of the burrs 71*a* can be more rounded than the burrs 71*b* and can have a greater radial height than the burrs 71*b*, thereby causing more grinding than cutting. Burrs 73 can extend from both burrs 71*a* and 71*b*. In some embodiments, the burrs 71*a* are equally spaced while in other embodiments, the positioning between the burrs 71*a* varies. In one exemplary embodiment, burrs 71*a* have a circumferential width of 0.176 inches and a radial height of 0.055 inches tapering to 0.010 inches, burrs 71*b* have a circumferential width of 0.1 inches and a radial height from 0.031 inches tapering to 0.007 inches at the bottom of the annular grinder, and burrs 73 have a circumferential width of 0.036 inches and a radial height from 0.005 inches tapering to 0.002 inches. In some embodiments, burrs 71*b* can have different dimensions from one another and/or burrs 71*a* can have different dimensions from one another. Burrs with a distribution of sizes serve to vary the clearance to the center grinder 12 as it rotates to ensure different pill and particle sizes are engaged by the burrs, preventing pill chunks from being trapped in the grooves of the center grinder 12 and not advancing to further grinding. Further, having both sharp burrs (e.g., 71*b*) and rounded burrs (e.g., 71*a*) can advantageously provide both slicing and grinding functions.

Figure 13B:
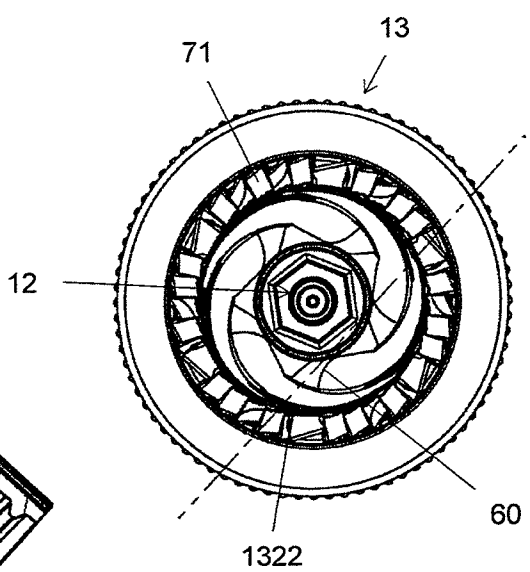
FIGS. 13A-13C show the relationship between the central grinder and the annular grinder.
Figure 13C:
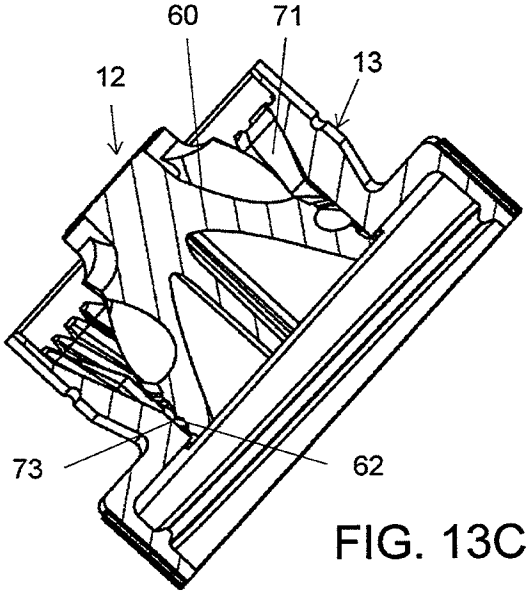
Figure 13A:
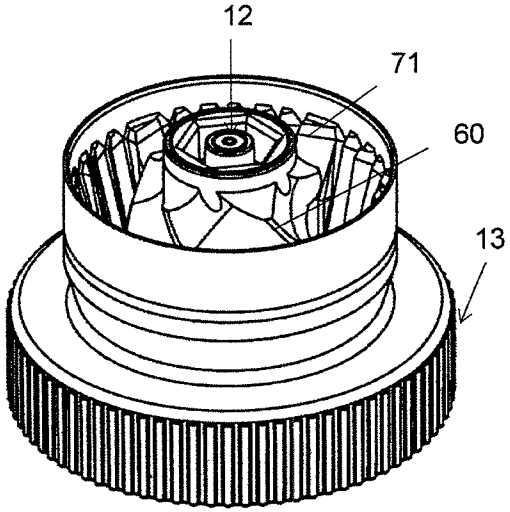
Figure 14C:
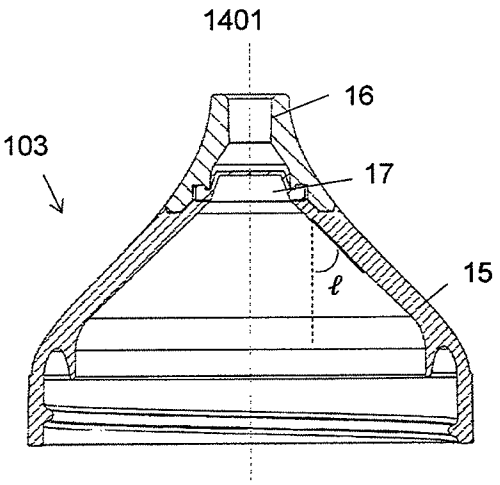
FIGS. 14A-14D show close-ups of the valved cap unit.
Figure 14D:
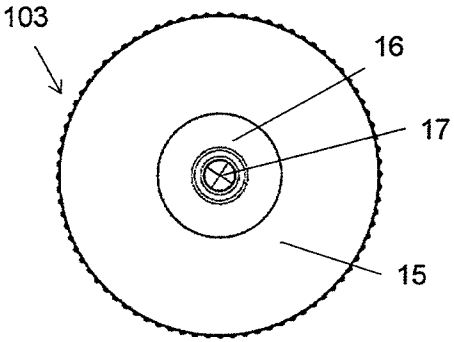
Figure 14B:
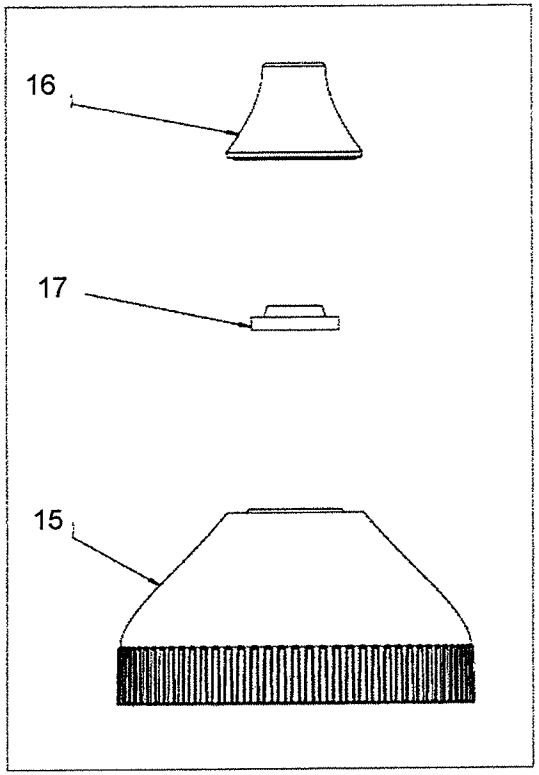
Figure 14A:
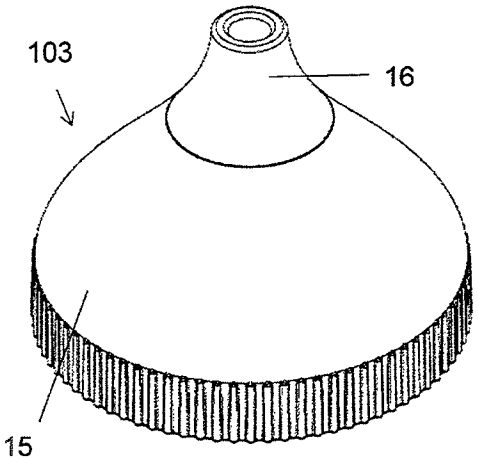

Referring to FIGS. 13A-13C, the central grinder 12 and annular grinder 13 can work together to grind pills or tablets inserted into the grinding unit 101. That is, as the central grinder 12 is rotated, the sharp edges 61 on the central grinder 12 can first grind the pill or tablet into pieces. The spiraling indentations 60 can trap the pieces and force them downward and against the large burrs 71 on the annular grinder 13, breaking them into smaller and smaller pieces. Further, the burrs 62 on the central grinder 12 can force the pill particles downward and against the small burrs 73 on the annular grinder 13. The powder particles will ultimately pass through a small gap 1322 (see also FIG. 5) between the central grinder 12 and the annular grinder 13 into the receptacle unit 102. The gap can be less than or equal to 0.05 inches, such as less than or equal to 0.04 inches, or less than or equal to 0.03 inches, thereby only allowing small particles therethrough. The uniformly ground particles then drop completely through grinding unit 101 into the receptacle unit 102. The profile and taper of the spiral grooves and the clearance between the annular grinder 12 and the center grinder 12 can be optimized, as described herein so that no small chunks of pill particles get trapped within the grooves and subsequently are not ground. Further, the interaction between the grinders 12, 13 guarantees that no particulates larger than the small space between the grinding surfaces can enter the receptacle, thus guaranteeing control over maximal particle size without being dependent on the user dexterity or visual acuity.

Figure 17B:
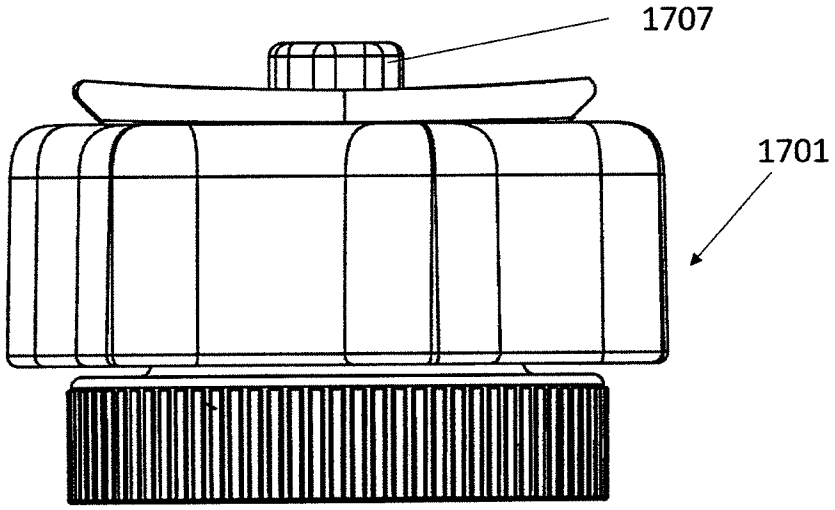
FIGS. 17A-17C show an exemplary medication grinding apparatus with adjustable spacing between the central grinder and annular grinder.
Figure 17C:
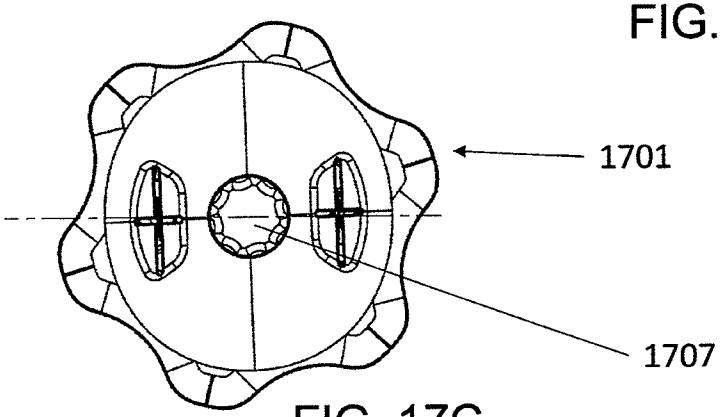
Figure 17A:
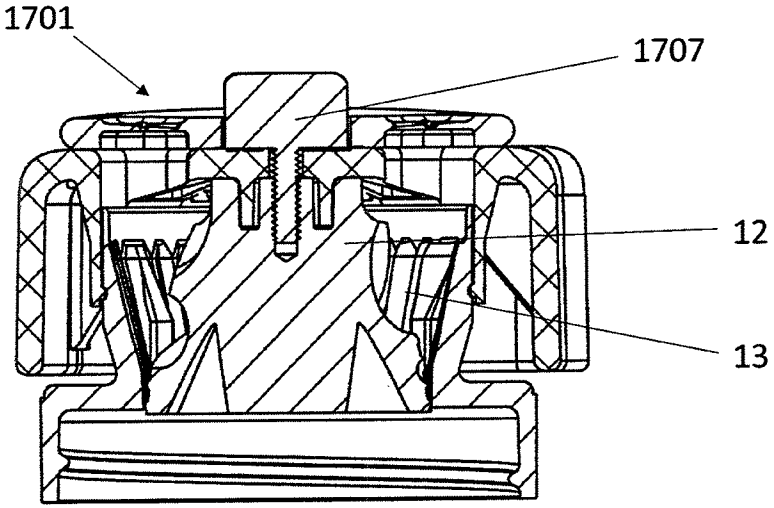
Figure 18:
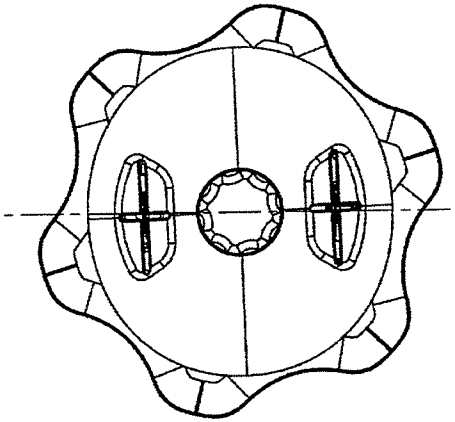
FIG. 18 is a cross-section that shows the medication grinding apparatus of FIGS. 17A-17C with adjustable spacing set to coarser grind.

In one embodiment, the space between the grinding surfaces can be fixed to guarantee a maximum particle size for a given use. In another embodiment, the spacing can be user adjusted by allowing the conical central grinder 12 to advance or retract relative to the annular grinder 13 to provide user adjustable coarseness. For example, the central grinder 12 can be configured with a tapered profile that, when raised, decreases or increases the gap between the central grinder 12 and the annular grinder 13. Referring to FIGS. 17A-17C, a grinding apparatus 1701 includes a screw 1707 configured to mate with the central grinder 12 to raise and lower the central grinder 12 relative to the annular grinder 13 (e.g., between the handle and the receptacle). The hexagonal features of the handle can keep the central grinder 12 rotating 1 to 1 with the handle even after the central grinder 12 is raised and lowered. The adjustable central grinder is shown positioned for a fine grind in FIG. 17A and positioned for a coarser grind in FIG. 18 (i.e., there is more space between the central grinder 12 and the annular grinder 13).

A close-up of the lid 10 is shown in FIGS. 8A-8D. A lip 52 on each of the protrusions 50 serves to keep the lid 10 in place when the protrusions 50 are inserted through openings 80 on the grinder handle 11. The slotted openings 9 can be made of a thin membrane of elastomer (such as the elastomer making up the rest of the lid 10). Slits 54 can be formed in the openings 9 along two orthogonal directions, as shown in FIGS. 8B and 8C. As shown in FIG. 8A, the edges of the slits 54 can be beveled to allow the edges to self-seal after being pushed apart by the insertion of a pill (avoiding overlapping of the edges that might otherwise occur without the bevel). In one embodiment, in order to optimize manufacturability, the slits 54 are formed by a mold that provides a gap between the flaps so that the part can be molded without a secondary slitting step. In another embodiment, the lip 52 is eliminated for ease of molding and manufacture, and the lid is kept in place by the interference fit of the elastomeric protrusions 50. The lid 10 advantageously allows pills or tables to be placed into the grinding unit 101 while preventing particulates and powder from being ejected from the apparatus 100 during use. Further, the slotted openings 9 advantageously allow the pills or tables to be placed into the grinding unit 101 without removing the lid 10. In other embodiments, the lid 10 does not have slits 9, but instead includes a sliding door that opens and closes, a cap, or any of several designs which have the utility of allowing for easy placement of pills and keeping medication form being ejected during grinding.

Figure 9A:
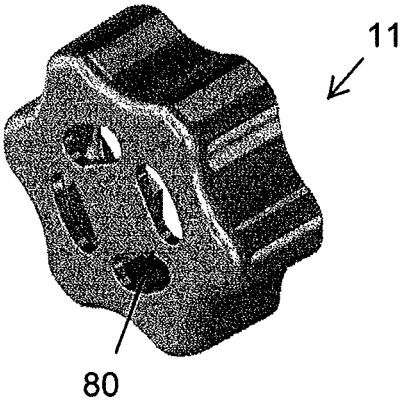
FIGS. 9A-9C show close-ups of a grinder handle of a medication grinding apparatus.
Figure 9B:
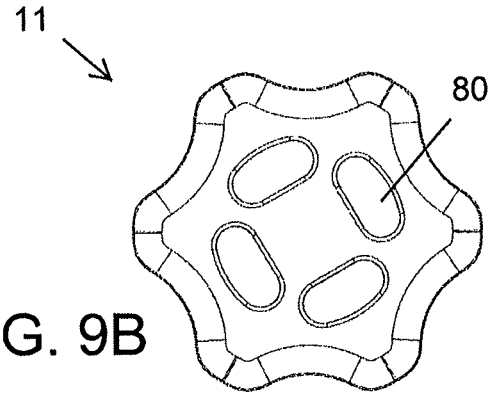
Figure 9C:
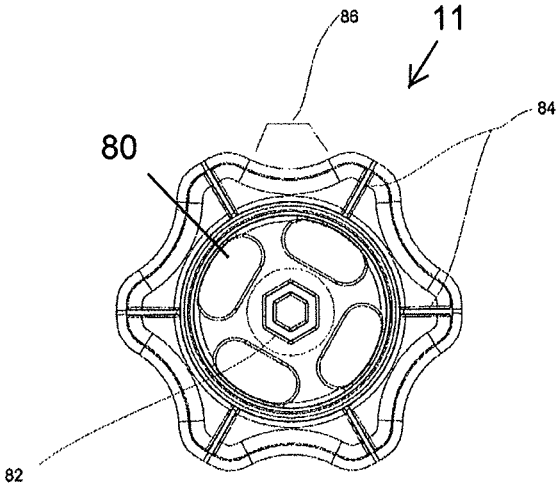

A close-up of the handle 11 is shown in FIGS. 9A-9C. As shown, the handle 11 has four openings 80 in the top thereof. Two openings 80 accept the lid pegs 50, and two openings 80 align with the slotted openings 9 on the lid 10 to allow pills to pass into the grinder unit 101. The hexagonal peg 82 that mates with the hexagonal indentation on the central grinder is shown in FIG. 9C. Support ribs 84 add strength to the gripping surface of the handle 11, keeping the device from deforming when pressure and torque are applied to the handle 11 by the user. In the embodiment shown, there are six indentations 86 for an improved ergonomic grip of the handle 11.

A close-up of the capped valve unit 103 including the cap body 15, the valve 17, and the port 16, is shown in FIGS. 14A-14D. The valved cap unit 103 can be molded to mate with the receptacle unit 101 by screwing or snapping together, thereby providing a water tight seal to prevent leakage during agitation. The valved cap unit 103 can be shaped with steep sides leading to a two-way valve 17. Indeed, the inner wall of the cap body 15 can be tapered such that it is at an angle $\alpha$ (see FIG. 14C) with the central or vertical axis 1401 of the device that is less than or equal to 60 degrees, such as less than or equal to 45 degrees, so as to avoid pooling of contents even if the apparatus is tipped slightly when withdrawing medication. Further, the cap body 15 can have no closed bottom, i.e., can be tapered to end at the valve 17. In some embodiments, the outer surface of the valved cap unit 103 is cone shaped. In other embodiments, the valved cap unit 103 includes a flat surface to allow the medication grinding apparatus 100 to sit on a surface by resting on the valved cap unit.

Figure 15B:
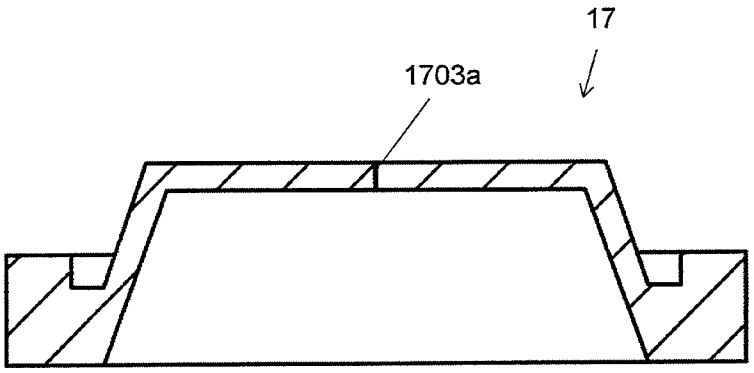
FIGS. 15A-15B show an exemplary valve for the valved cap unit.
Figure 15A:
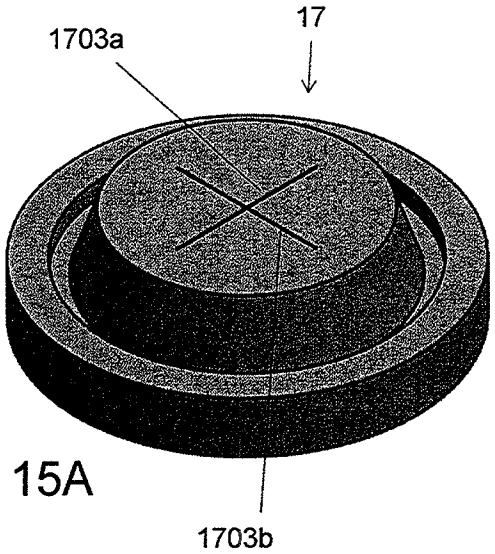

Referring to FIGS. 15A-B, in one embodiment, the valve 17 can be a two-way slit valve having two slits 1703*a,b*. The valve 17 can be made, for example, of food grade silicone or other soft elastomeric material. The slits 1703*a,b* of the valve 17 can be set to open at a pre-determined pressure (i.e., caused by pressure of the liquid being injected or suction caused by a syringe) and can self-close when the pressure is relieved. In one embodiment, the valve can be Minivalve's XFRAGM valve.

Figure 16B:
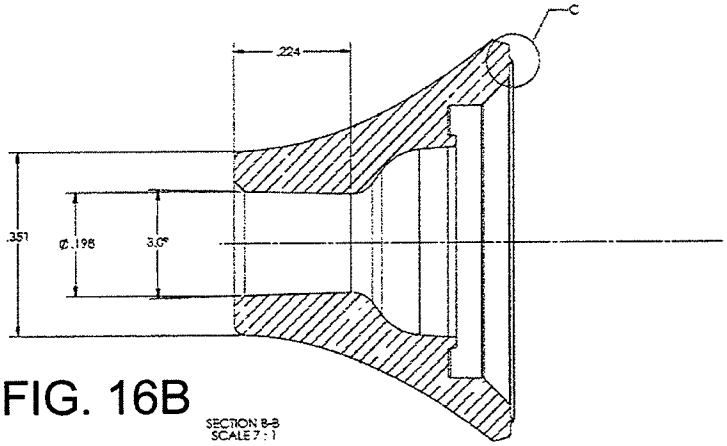
FIGS. 16A-16C show an enteral port connection.
Figure 16A:
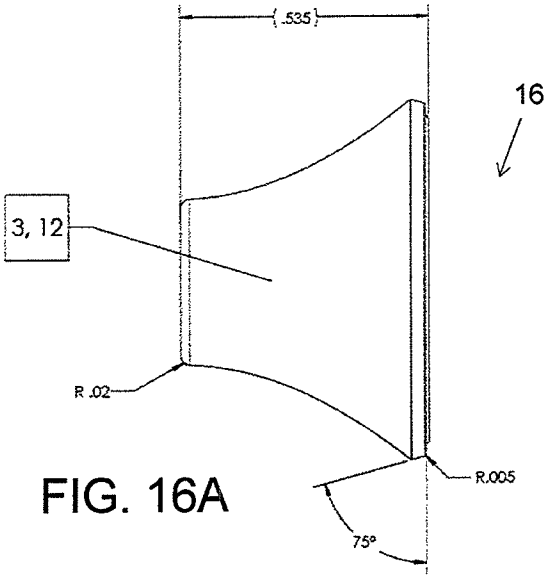
Figure 16C:
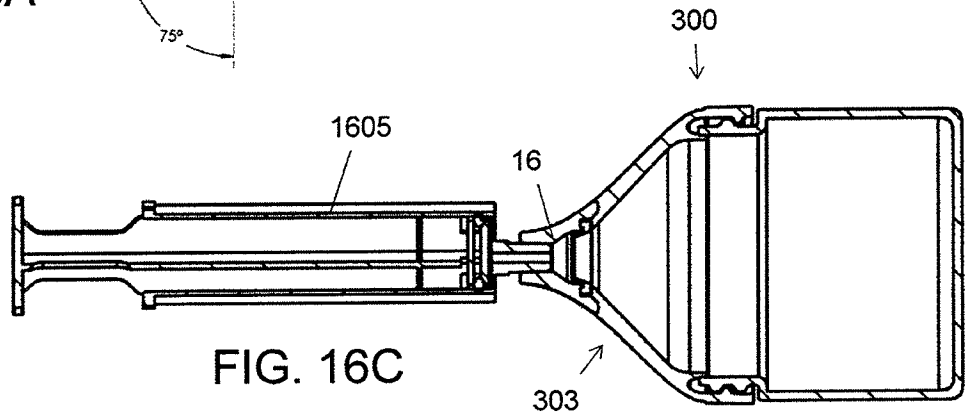

Referring to FIGS. 16A-C, in one embodiment, the port 16 is shaped and configured for connection to only enteral type syringes, i.e., is incompatible with luer type syringes. In one embodiment, the port 16 includes a female syringe connector comprised of a rigid wall with an outermost circular aperture and taper adapted to mate with enteral tipped syringes. The aperture, taper, and wall thickness of the port 16 (all of which are shown in FIGS. 16A-B) make it compatible with enteral type syringes and incompatible with luer tipped syringes. For example, in one embodiment, the taper of the port 16 can be approximately 3 degrees, the outer diameter at the opening can be 0.0351 inches, the inner diameter at the opening can be 0.198 inches, and the depth of the port 16 can be at least 0.224 inches. A port 16 in use with an enteral syringe 1605 is shown in FIG. 16C. In one embodiment of the present invention, the valved syringe connector can be configured to have features to mate with an ISO (International Organization for Standardization) enteral connector, such as the ENFit connector.

Figure 10:
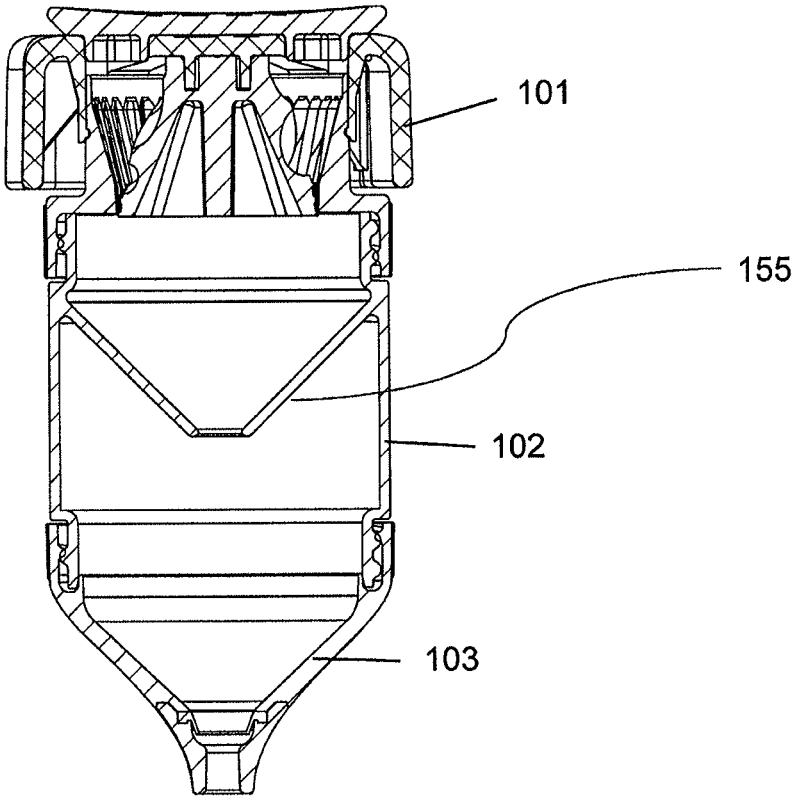
FIG. 10 shows a receptacle of a medication grinding apparatus with a conical guard that prevents liquid from entering the grinder portion when liquid medication in the lower portion of the receptacle is agitated.

In some embodiments, the receptacle unit 102 can include a guard to prevent liquid from entering the grinder unit 101 when liquid is supplied through the valved cap unit 103. FIG. 10, for example, shows a conical guard 155 within the cylindrical body 15 configured to prevent liquid from entering the grinder portion during agitation. A small opening in the bottom of the funnel can allow powder to fall through, but not allow liquid up into the grinder unit 101, e.g., when the apparatus is held vertically.

Figure 11B:
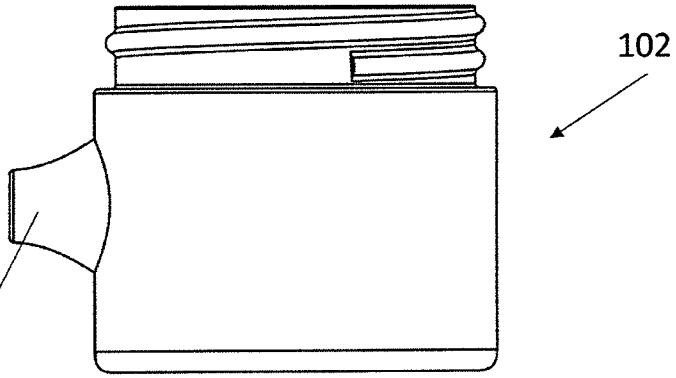
FIGS. 11A-11C show an embodiment of a receptacle unit with an integrated port.
Figure 11C:
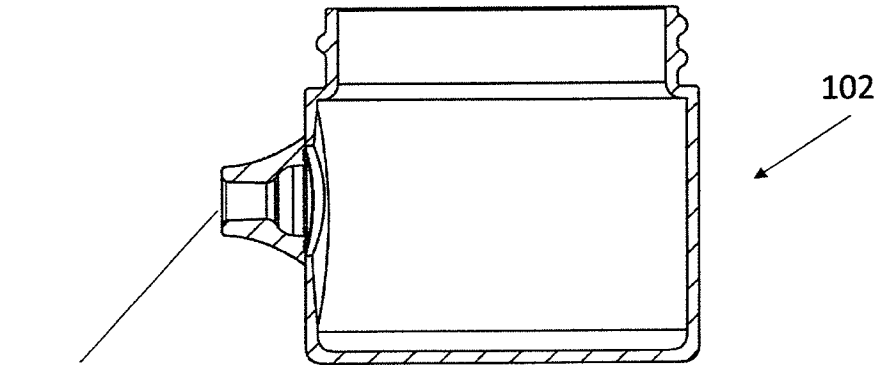
Figure 11A:
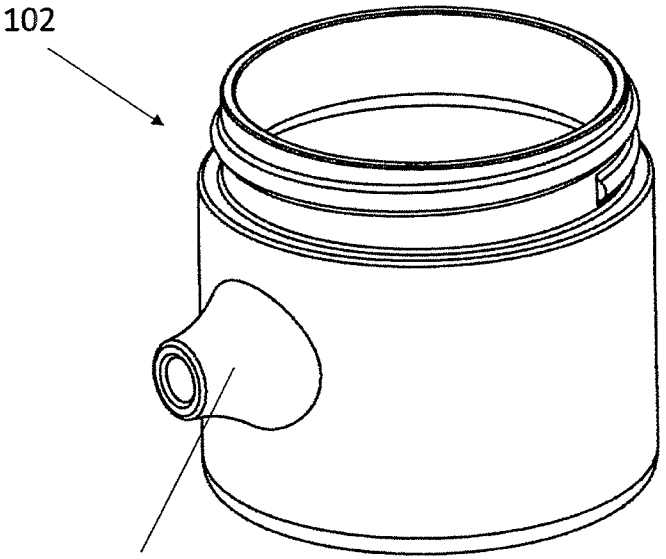

In some embodiments, the valved cap unit 103 is not attachable/detachable from the receptacle unit 102, but is rather integrated with the receptacle unit 102. Further, in some embodiments, the port body can be directly connected to the receptacle rather than part of a capped unit. For example, FIGS. 11A-11C shows a port 1116 integrated with a receptacle unit 102. As shown, the port 1116 can extend from the side of the receptacle unit 102, but can otherwise include features equivalent or similar to those described above with respect to port 16.

In some embodiments, the valved cap unit 103, reservoir unit 102, and grinder unit 101 can be integrated together as a single piece.

The units 101, 102, and 103 can be made of various materials. In one embodiment, the grinding unit 101 is made of hard plastic (such as food grade polycarbonate), treated glass, ceramic, or metal. The grinder handle 11 and/or lid 10 can also be made of plastic, ceramic, or metal, or softer substances such as silicone, rubber or softer plastics. The receptacle unit 102 can be made of clear, frosted, or colored plastic or glass. In some embodiments, the receptacle has labeling designating the function of the device, or liquid volume markers, and may also have other writing or no writing at all.

In some embodiments where oral delivery is required, once the medication solution/suspension is mixed in the capped receptacle, the patient may suck the medication out of the receptacle and into their mouth by placing their lips directly around the valved connector unit 103.

In one embodiment, wherein the suspension is to be used for oral delivery, the liquid provided for the suspension can be flavored, or flavoring can be added to the mixing receptacle.

Figure 19B:
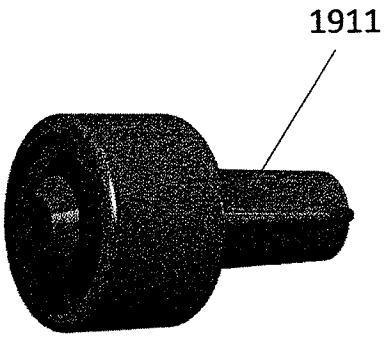
FIGS. 19A and 19B show exemplary adaptors for a type of enteral connector.

In one embodiment, an adapter is provided that on one end mates with the port 16 as described above, and on the other end provides connector features to mate with other types of devices. For example, as shown in FIG. 19B, in one embodiment, the adaptor 1911 can have one end to mate with the port 16 and the opposite end configured with an emerging ISO enteral connector, the ENFit connector. In another embodiment, an adaptor is configured to mate with the port 16 on one end and a catheter tipped irrigation syringe typically used with the installed base of feeding tubes.

Figure 19A:
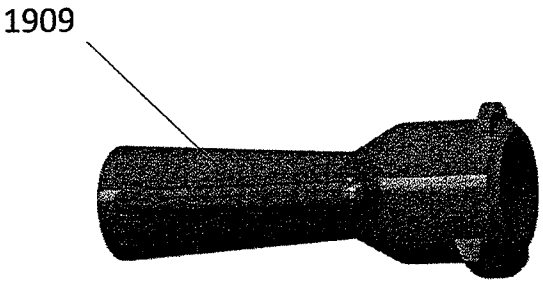

In some embodiments, to enable use with existing feeding tubes or other devices not yet containing current or future enteral connector features, but rather containing conventional, softer elastomeric ports compatible with catheter tipped irrigation syringes, an adaptor can be used that, on one end, mates with an oral or enteral tipped syringe and on the other end, is configured as an irrigation tipped syringe. In such an embodiment, an oral syringe, is used to draw up the medication suspension/solution from the receptacle, and then the syringe adapter is placed on the tip of the syringe so that it can mate with the feeding tube for administration of the medication into the patient. In yet another embodiment, an adaptor is configured to mate with an oral tipped syringe compatible with port 16, and the opposite end configured with an emerging ISO enteral connector, the ENFit connector, as shown in adaptor 1909 of FIG. 19A.

In another embodiment of the invention, the geometry of the port 16 itself is configured so that an adaptor is not necessary. For example, in the future, the most prevalent syringes used for enteral applications may change to be consistent with the ENFit connector or with a similar connector. In this case, the geometry of port 16 would be configured to be compatible with the future enteral syringes without detracting from the scope of the present invention.

In yet a further embodiment of the invention, the valved cap allows a user the ability to draw up medication with an enteral syringe from any receptacle to which the valved cap may be adapted to fit. This allows the expanded use of the valved cap to draw up medications that do not need crushing because they already come in liquid solutions or suspensions. This would advantageously allow for safe drawing up of these medications without leaking and protect against accidental drawing of medication meant for enteral administration into a luer tipped syringe. A valved cap may be adapted to fit on many different types of bottles that hold medication to assist the user in safely and easily drawing up medication from whatever receptacle the valved cap may be adapted to fit. The two-way valved cap can advantageously prevent spillage and contamination.

In one embodiment, a cap without a valve is used in place of a valved cap. In such an embodiment, the port can have a removable cap and/or an open hole that the user can cover during use, such as with his or her finger.

In one embodiment, an angle within the valved cap body 15 is less than 45 degrees and/or is multi-faceted with two or more nested cones.

In one embodiment, a lubricant can be added to portions of the device. For example, a lubricant can be added to the annular grinder, such as be injection molded into the annular grinder, in order to increase lubricity of the surface and/or reduce residual sticking of pill particles.

Advantageously, the grinding apparatuses and methods described herein allow for reliable, fine grinding of solid medication and can be easily and safely used by visually or physically impaired persons. Such a device can ensure that at least 95%, at least 97%, at least 99%, or 100% of the particles have a maximum dimension of less than 2 mm, such as less than 1 mm, such as less than 0.5 mm, after the grinding process. This method advantageously is not dependent on the users dexterity or visual acuity.

The grinding apparatuses and methods described herein can advantageously be used to grind pills between 10 mg and 500 mg and/or pills of between 0.004 $in^3$ and 0.066 $in^3$ without having to change the grinder or grinding mechanism. Likewise, the grinding apparatuses and methods described herein can advantageously be used to grind oblong pills up to 0.780 in ×0.35 in×0.30 in, round pills up to 0.6 in diameter by 0.25 in thick, and also small pills of 0.25 in in diameter and 0.09 in thick.

Advantageously, more than 85%, such as more than 90% or more than 95%, of the powder captured in the receptacle unit can be removed by the syringe. Likewise, more than 95% of the pills placed into the grinder unit can be captured by the grinder unit and moved to the receptacle unit.

In one embodiment, the medication grinding apparatus described herein can be used with a rectal medication administration device, such as that disclosed in U.S. Pat. No. 8,259,543, the entirety of which is incorporated by reference herein.

The medication grinding apparatus and method described herein can advantageously be used to grind medication for enteral delivery. Other specific uses of the device could include, but would not be limited to, improving the general process of medication crushing, mixing and administering to children who cannot swallow tablets or who might prefer a flavored suspension. The device could also be beneficial for the administration of medication to animals as it is often difficult to get animals to swallow medications.

In some embodiments, the grinding unit described herein can be used without the receptacle and/or cap so that patients/users can grind the pills or tablets into a receptacle or container of their choosing.

Further, although generally referred to hereinabove as a medication grinding apparatus or a method of grinding a medication, it is to be understood that vitamins, supplements, and other pills/tablets can be used with the device. It is also to be understood that the terms "pill" or "tablet" can be used interchangeably.

It will be apparent to a skilled artisan that the embodiments described herein are exemplary of inventions that may have greater scope than any of the singular descriptions presented. There may be alterations made in these examples without departing from the spirit and scope of the invention disclosed. For example, any aspect of the above described method and device for simplified crushing, liquefying, and preparation of medications may have components with different shapes or designs within different embodiments. For instance, the shape or dimensions of the grinder burrs may change, the size or number of the ergonomic indentations on the grinder handle may vary, the valve type and compositions may vary in design from one embodiment to another, but not overall function. These or other features may change in different embodiments.

The invention claimed is:

1. An apparatus for liquefying solid pills, comprising:

a grinder configured to grind the solid pills to a powder, wherein the grinder includes an annular grinder portion and a central grinder portion, wherein the annular grinder portion and the central grinder portion are rotatable with respect to one another, further wherein the annular grinder portion includes at least one circumferential row of teeth, the teeth having varying sizes along the circumferential row, wherein the central grinder portion comprises spiraling indentations with sharp edges along an outer surface of the central grinder, the sharp edges formed on an outer profile of the indentations such that each indentation is positioned between sharp edges, the indentations decreasing in size as they transition from an upper portion of the central grinder to a lower portion of the central grinder;

a receptacle configured to attach to the grinder proximate to the lower portion and to capture the powder; and a cap configured to attach to the receptacle, the cap including a port therethrough in fluid connection with the receptacle, the port configured to mate with a tip of a syringe for injection or withdrawal of a liquid therethrough.

2. The apparatus of claim 1, further comprising a lid configured to cover the grinder, wherein the lid includes a slotted opening configured to allow the solid pills to pass therethrough.

3. The apparatus of claim 2, wherein the lid is configured to be attached and detached from the grinder.

4. The apparatus of claim 1, wherein the circumferential row of teeth are on an inner surface of the annular grinder portion and wherein the teeth of the annular grinder portion, the spiraling indentations and the sharp edges of the spiraling indentations of the central grinder portion are together configured to grind the solid pills to the powder when the annular grinder portion and the central grinder portion are rotated with respect to one another.

5. The apparatus of claim 1, wherein there is an opening between the annular grinder portion and the central grinder portion that is less than or equal to 0.05 inches wide, the opening in communication with the receptacle for passage of the powder thereto.

6. The apparatus of claim 1, wherein the port is configured to mate with a tip of an enteral syringe.

7. The apparatus of claim 1, wherein the port is configured to mate with a tip of an oral syringe.

8. The apparatus of claim 1, wherein the port includes a valve therein.

9. The apparatus of claim 1, wherein a portion of the plurality of teeth are rounded and a portion of the plurality of teeth are sharp.

10. The apparatus of claim 1, wherein the cap is configured to attach to the receptacle at a same location as the grinder.

11. The apparatus of claim 1, wherein the central grinder comprises a tapered shape with a greater diameter at the lower portion than the upper portion.

12. The apparatus of claim 1, wherein the central grinder comprises spiraling burrs along the outer surface towards the lower portion of the central grinder.

13. The apparatus of claim 1, further comprising a lubricant added to the annular grinder during its molding.

14. The apparatus of claim 1, wherein the sharp edges on the central grinder are configured to first grind the pill into pieces and the spiraling indentations are configured to trap the pieces and force them downward and against the teeth of the annular grinder, breaking them into smaller and smaller pieces.

15. A grinder system configured to grind solid pills to a powder, comprising:

a receptacle having a mating surface with a locking mechanism thereon;

a grinder configured to lock to the receptacle at the locking mechanism on the mating surface, the grinder comprising:

an annular grinder portion having teeth on an inner surface thereof;

a central grinder portion having sharp edges on an outer surface thereof, the teeth of the annular grinder portion and the sharp edges of the inner grinder portion together configured to grind the solid pills to a powder;

a handle attached to the grinder and configured to rotate to allow the grinder to grind the solid pills to the powder; and a lid attached to the handle and configured to cover the grinder, the lid including an opening therein configured to allow solid pills to pass therethrough; and a cap that is interchangeable with the grinder, the cap configured to lock to the receptacle at the locking mechanism on the mating surface, the cap including a valved port therethrough in fluid connection with the receptacle, the valved port configured to mate with a tip of a syringe for injection or withdrawal of a liquid therethrough.

16. The system of claim 15, wherein the annular grinder portion and the central grinder portion are rotatable with respect to one another, the relative rotation configured to grind the solid pills to the powder.

17. The system of claim 15, wherein there is an opening between the annular grinder portion and the central grinder portion that is less than or equal to 0.05 inches wide.

18. The system of claim 15, wherein a tooth radius of each of the teeth in the annular grinder is less than or equal to 0.03 inches.

19. The system of claim 15, wherein the teeth of the annular grinder portion are at least two different sizes along an inner circumference thereof.

20. The system of claim 15, wherein the handle includes a plurality of ergonomic indentations therein.

21. The system of claim 15, wherein the opening further extends through the handle.

* * * * *